US008850617B2

(12) United States Patent
Higgins

(10) Patent No.: US 8,850,617 B2
(45) Date of Patent: Oct. 7, 2014

(54) SWEATBAND FOR HEADWEAR

(75) Inventor: Alan Norman Higgins, Toronto (CA)

(73) Assignee: Innovision Headwear Inc., Markham, Ontario (CA)

( * ) Notice: Subject to any disclaimer, the term of this patent is extended or adjusted under 35 U.S.C. 154(b) by 535 days.

(21) Appl. No.: 12/575,925

(22) Filed: Oct. 8, 2009

(65) Prior Publication Data

US 2010/0095430 A1 Apr. 22, 2010

Related U.S. Application Data

(60) Provisional application No. 61/103,805, filed on Oct. 8, 2008.

(51) Int. Cl.
*A42C 5/02* (2006.01)

(52) U.S. Cl.
CPC ..... *A42C 5/02* (2013.01)
USPC ..... 2/181

(58) Field of Classification Search
USPC ..... 2/181, 181.2, 181.4, 181.6, 181.8, 2/182.1, 182.2, 182.3, 182.5
See application file for complete search history.

(56) References Cited

U.S. PATENT DOCUMENTS 4,130,902 A * 12/1978 Mackenroth et al. ..... 2/7

(Continued)

FOREIGN PATENT DOCUMENTS

CA 2 353 128 A1 1/2003
GB 190614374 A 0/1907

(Continued)

OTHER PUBLICATIONS

International Search Report and Written Opinion dated Dec. 3, 2009 for corresponding International Application No. PCT/CA2009/001335.

*Primary Examiner* — Katherine Moran
(74) *Attorney, Agent, or Firm* — Ohlandt, Greeley, Ruggiero & Perle, L.L.P.

(57) ABSTRACT

There is provided a sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface comprising: at least one pair of spaced-apart successive head contacting domains, wherein at least a respective portion of each one of the spaced-apart successive head contacting domains of each one of the at least one pair of spaced-apart successive head contacting domains is configured to contact the head of the wearer when the headwear is worn on a human head; and a channel configured to facilitate air flow between a space above the sweatband and a space below the sweatband when the headwear is worn on a human head, wherein the channel is defined by at least one recessed domain and each one of the at least one recessed domain is defined between a respective edge portion of each one of the spaced-apart successive head contacting domains of a one of the at least one pair of spaced-apart successive head contacting domains; such that, when the headwear is being worn on a human head, and the human head is positioned such that a plane tangent to the highest portion of the human head is substantially horizontal, and for each one of the at least one recessed domain of the channel, at least the respective edge portions of each one of the spaced-apart successive head contacting domains, between which the recessed domain is disposed, are disposed in contact with the human head such that there is provided a passage configured to flow air between a space above the sweatband and a space below the sweatband and the passage includes a minimum cross-sectional area of at least 0.5 square millimeters (0.5 $mm^2$).

10 Claims, 6 Drawing Sheets

(56) References Cited

U.S. PATENT DOCUMENTS

| | | | | |
|---|---|---|---|---|
| 5,025,504 | A * | 6/1991 | Benston et al. | 2/181.4 |
| 5,101,516 | A * | 4/1992 | Scarnato | 2/181.2 |
| 5,926,849 | A * | 7/1999 | Boyle | 2/181.8 |
| 2007/0199132 | A1 * | 8/2007 | Lehmann | 2/181 |

FOREIGN PATENT DOCUMENTS

| | | | |
|---|---|---|---|
| GB | 190909533 | A | 0/1909 |
| GB | 191008166 | A | 0/1910 |
| GB | 191514035 | A | 9/1916 |
| JP | 2001207322 | A | 8/2001 |

* cited by examiner 1001
100
108
106
116
102
104

SWEATBAND FOR HEADWEAR

FIELD OF INVENTION

This invention relates to sweatbands and, in particular, to sweatbands for headwear.

BACKGROUND OF THE INVENTION

Generally, most headwear includes a sweatband incorporated within the interior portion of the crown. The sweatband is provided for absorbing sweat exuded by the wearer of the headwear, and thereby protects the crown from discoloration. Existing sweatbands, however, are not suitably designed to facilitate adequate air flow across the sweatband (ie. between spaces provided above and below the sweatband), when the headwear is being worn, to thereby effect adequate cooling of the wearer's head.

SUMMARY OF THE INVENTION

In one aspect, there is provided a sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface comprising: at least one pair of spaced-apart successive head contacting domains, wherein at least a respective portion of each one of the spaced-apart successive head contacting domains of each one of the at least one pair of spaced-apart successive head contacting domains is configured to contact the head of the wearer when the headwear is worn on a human head; and at least one channel, wherein each one of the at least one channel is configured to facilitate air flow between a space above the sweatband and a space below the sweatband when the headwear is worn on a human head; such that, when the headwear is free-standing and is supported on a horizontally planar surface such that at least a rear portion of the lower edge of the crown is contacting the horizontally planar support surface, and for at least one operative channel, wherein each one of the at least one operative channel is at least a portion of one of the at least one channel and is defined by at least one recessed domain and each one of the at least one recessed domain is defined between a respective edge portion of each one of the spaced-apart successive head contacting domains of a one of the at least one pair of spaced-apart successive head contacting domains, and for each one of the at least one recessed domain of each one of the at least one operative channel, within each horizontal plane which traverses each one of the spaced-apart head contacting domains of the pair of spaced-apart successive head contacting domains between which the recessed domain is disposed, each one of the spaced-apart head contacting domains of the pair of spaced-apart successive head contacting domains between which the recessed domain is disposed includes a most internally extending outermost surface portion, and the recessed domain includes a most internally extending outermost surface portion and is characterized by a first recess depth relative to a one of the spaced-apart successive head contacting domains of the pair of spaced-apart successive head contacting domains between which the recessed domain is disposed, wherein the first recess depth is a linear distance between a plane tangent to the most internally extending outermost surface portion of the one of the spaced-apart successive head contacting domains of the pair of spaced-apart successive head contacting domains between which the recessed domain is disposed and a plane tangent to the most internally extending outermost surface portion of the recessed domain, and the recessed domain is also characterized by a second recess depth relative to the other one of the spaced-apart successive head contacting domains of the pair of spaced-apart successive head contacting domains between which the recessed domain is disposed, wherein the second recess depth is a linear distance between a plane tangent to the most internally extending outermost surface portion of the other one of the spaced-apart successive head contacting domains of the pair of spaced-apart successive head contacting domains and a plane tangent to the most internally extending outermost surface portion of the recessed domain, wherein the first recess depth is at least 0.5 millimeters and the second recess depth is at least 0.5 millimeters.

In another aspect, there is provided a sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface defining at least one channel, wherein each one of the at least one channel is configured to facilitate air flow between a space above the sweatband and a space below the sweatband when the headwear is worn on a human head, and wherein at least one of the at least one channel is an operative channel, and the minimum width of each one of the at least one operative channel is at least 1.0 millimeters.

In a further aspect, there is provided sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface comprising: at least one pair of spaced-apart successive head contacting domains, wherein at least a respective portion of each one of the spaced-apart successive head contacting domains of each one of the at least one pair of spaced-apart successive head contacting domains is configured to contact the head of the wearer when the headwear is worn on a human head; and at least one channel, wherein each one of the at least one channel is configured to facilitate air flow between a space above the sweatband and a space below the sweatband when the headwear is worn on a human head; such that, when the headwear is being worn on a human head, and the human head is positioned such that a plane tangent to the highest portion of the human head is substantially horizontal, and for at least one operative channel, wherein each one of the at least one operative channel is a one of the at least one channel and is defined by at least one recessed domain and each one of the at least one recessed domain is defined between a respective edge portion of each one of the spaced-apart successive head contacting domains of a one of the at least one pair of spaced-apart successive head contacting domains, and for each one of the at least one recessed domain of each one of the at least one operative channel, at least the respective edge portions of each one of the spaced-apart successive head contacting domains, between which the recessed domain is disposed, are disposed in contact with the human head such that there is provided a passage configured to flow air between a space above the sweatband and a space below the sweatband and the passage includes a minimum cross-sectional area of at least 0.5 square millimeters (0.5 $mm^2$).

In a further aspect, there is provided a sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface comprising: at least one pair of spaced-apart successive head contacting domains, wherein at least a respective portion of each one of the spaced-apart successive head contacting domains of each one of the at least one pair of spaced-apart successive head contacting domains is configured to contact the head of the wearer when the headwear is worn on a human head; and a channel configured to facilitate air flow between a space above the sweatband and a space below the sweatband when the headwear is worn on a human head; such that, when the headwear is free-standing and is supported on a horizontally planar surface such that at least a rear portion of the lower edge of the crown is contacting the horizontally planar support surface, at least a portion of the channel is defined by at least one recessed domain and each one of the at least one recessed domain is defined between a respective edge portion of each one of the spaced-apart successive head contacting domains of a one of the at least one pair of spaced-apart successive head contacting domains, and for each one of the at least one recessed domain of the channel, within each horizontal plane which traverses each one of the spaced-apart head contacting domains of the pair of spaced-apart successive head contacting domains between which the recessed domain is disposed, each one of the spaced-apart head contacting domains of the pair of spaced-apart successive head contacting domains between which the recessed domain is disposed includes a most internally extending outermost surface portion, and the recessed domain includes a most internally extending outermost surface portion and is characterized by a first recess depth relative to a one of the spaced-apart successive head contacting domains of the pair of spaced-apart successive head contacting domains between which the recessed domain is disposed, wherein the first recess depth is a linear distance between a plane tangent to the most internally extending outermost surface portion of the one of the spaced-apart successive head contacting domains of the pair of spaced-apart successive head contacting domains between which the recessed domain is disposed and a plane tangent to the most internally extending outermost surface portion of the recessed domain, and the recessed domain is also characterized by a second recess depth relative to the other one of the spaced-apart successive head contacting domains of the pair of spaced-apart successive head contacting domains between which the recessed domain is disposed, wherein the second recess depth is a linear distance between a plane tangent to the most internally extending outermost surface portion of the other one of the spaced-apart successive head contacting domains of the pair of spaced-apart successive head contacting domains and a plane tangent to the most internally extending outermost surface portion of the recessed domain, wherein the first recess depth is at least 0.5 millimeters and the second recess depth is at least 0.5 millimeters.

In a further aspect, there is provided a sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface defining a channel, wherein the channel is configured to facilitate air flow between a space above the sweatband and a space below the sweatband when the headwear is worn on a human head, and the minimum width of the channel is at least 1.0 millimeters.

In a further aspect, there is provided a sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface comprising: a plurality of pairs of spaced-apart successive head contacting domains, wherein at least a respective portion of each one of the spaced-apart successive head contacting domains of each one of the plurality of pairs of spaced-apart successive head contacting domains is configured to contact the head of the wearer when the headwear is worn on a human head; and a plurality of channels, wherein each one of the plurality of channels is configured to facilitate air flow between a space above the sweatband and a space below the sweatband when the headwear is worn on a human head; such that, when the headwear is being worn on a human head, and the human head is positioned such that a plane tangent to the highest portion of the human head is substantially horizontal, and for at least two operative channels, wherein each one of the at least two operative channels is a one of the plurality of channels and is defined by at least one recessed domain and each one of the at least one recessed domain is defined between a respective edge portion of each one of the spaced-apart successive head contacting domains of a one of the plurality of pairs of spaced-apart successive head contacting domains, and for each one of the at least one recessed domain of each one of the plurality at least two operative channels, at least the respective edge portions of each one of the spaced-apart successive head contacting domains, between which the recessed domain is disposed, are disposed in contact with the human head such that there is provided a passage configured to flow air between a space above the sweatband and a space below the sweatband and the passage includes a minimum cross-sectional area of at least 0.5 square millimeters (0.5 $mm^2$).

In a further aspect, there is provided a sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface comprising: a plurality of pairs of spaced-apart successive head contacting domains, wherein at least a respective portion of each one of the spaced-apart successive head contacting domains of each one of the plurality of pairs of spaced-apart successive head contacting domains is configured to contact the head of the wearer when the headwear is worn on a human head; and a plurality of channels, wherein each one of the plurality of channels is configured to facilitate air flow between a space above the sweatband and a space below the sweatband when the headwear is worn on a human head, and wherein at least two of the plurality of channels are operative channels such that at least two operative channels are provided, and each one of the at least two operative channels includes a minimum width of at least 1.0 millimeters.

BRIEF DESCRIPTION OF DRAWINGS

The preferred embodiments of the invention will now be described with reference to the following accompanying drawings.

DETAILED DESCRIPTION OF PREFERRED EMBODIMENTS

Figure 1:
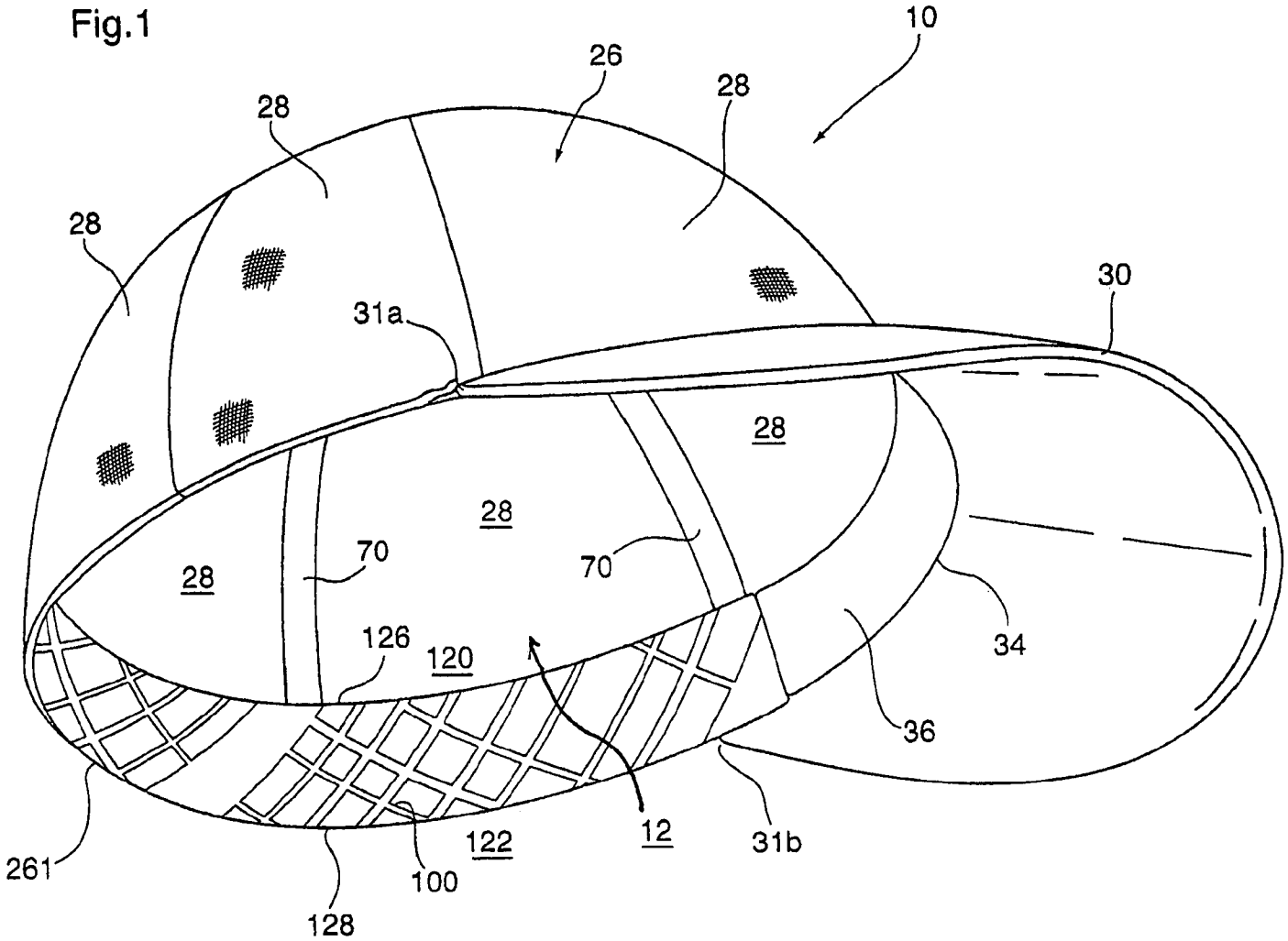
FIG. 1 is a bottom perspective view of a headwear.
Figures 2, 3, 4, 5, 6, 7:
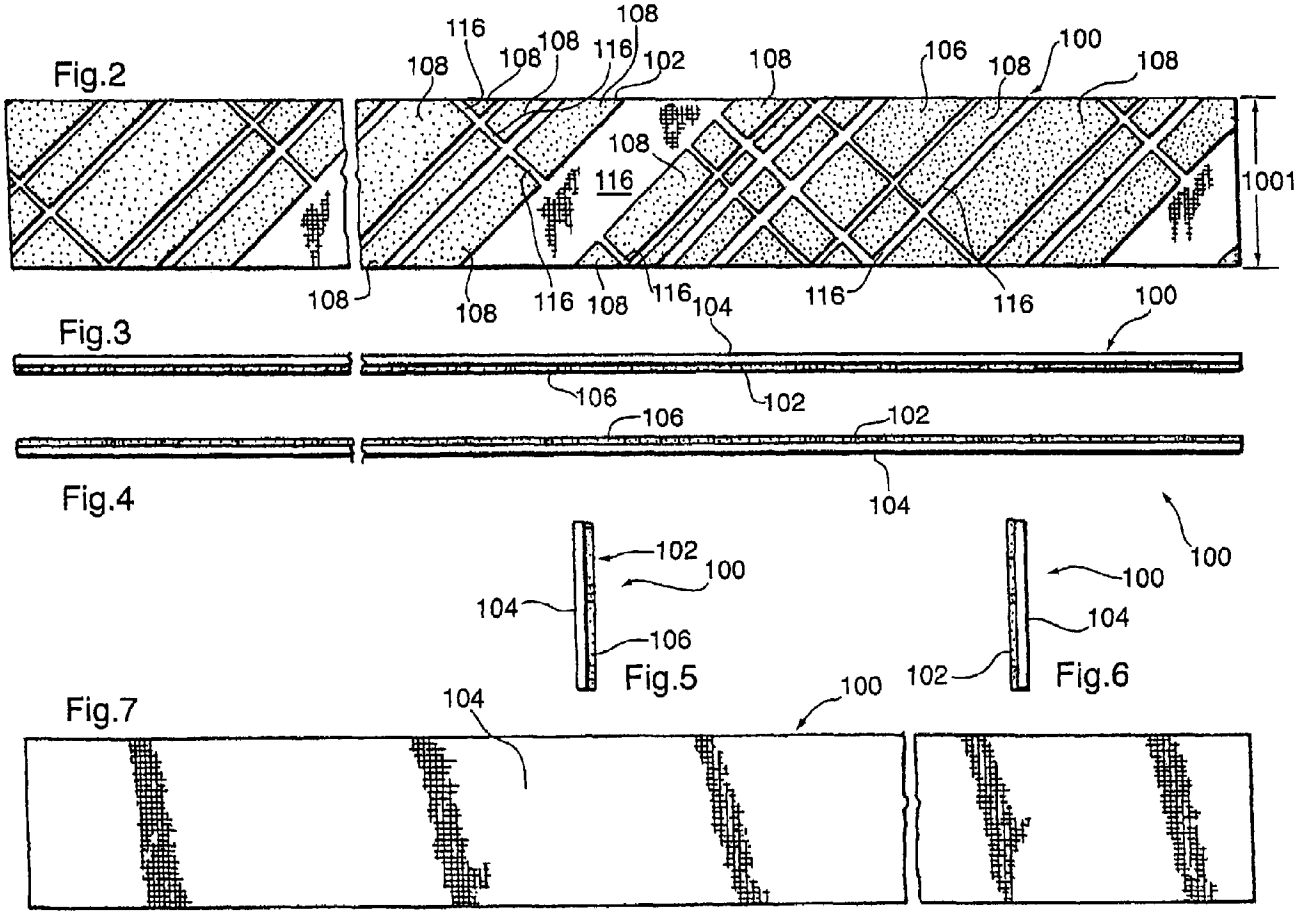
FIG. 2 is an elevation view of one side of the sweatband of the headwear of FIG. 1, in a flattened-out condition.
FIG. 3 is a top plan view of the sweatband of the headwear of FIG. 1, in a flattened-out condition.
FIG. 4 is a bottom plan view of the sweatband of the headwear of FIG. 1, in a flattened-out condition.
FIG. 5 is an end elevation view of one end of the sweatband of the headwear of FIG. 1, in a flattened-out condition.
FIG. 6 is an end elevation view of an end of the sweatband of the headwear of FIG. 1, opposite to the end illustrated in FIG. 5, wherein the sweatband is in a flattened-out condition.
FIG. 7 is an elevation view of a second side of the sweatband of the headwear, opposite to the side illustrated in FIG. 2.
Figure 8:
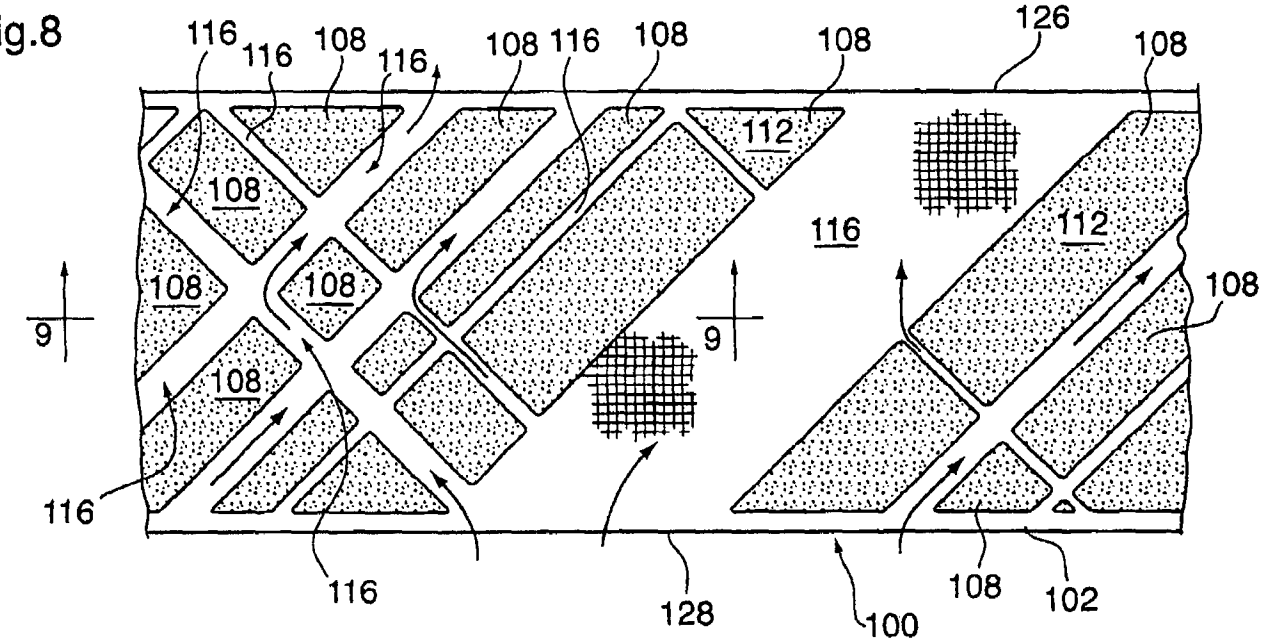
FIG. 8 is a fragmentary view of a portion of the side of the sweatband illustrated in FIG. 2, illustrating the air flow patterns configured to be facilitated by the channels provided in the sweatband.
Figure 9:
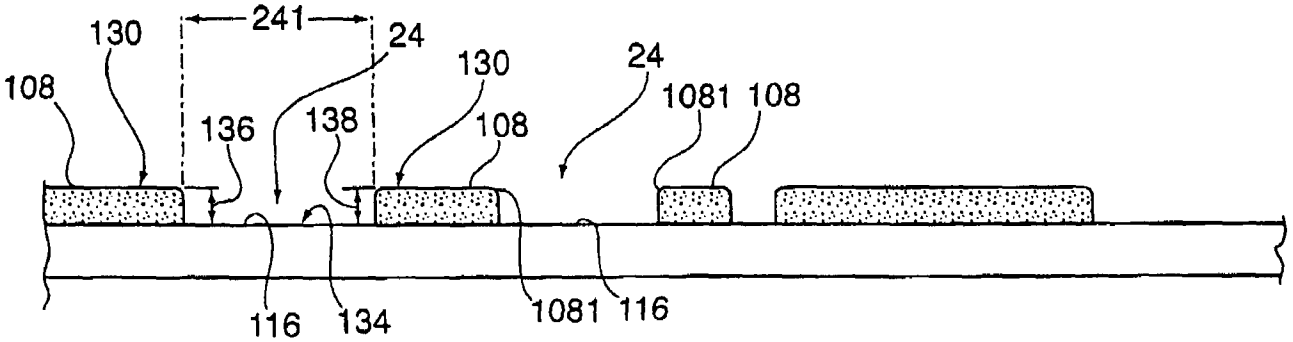
FIG. 9 is a fragmentary top plan view of the sweatband of the headwear in FIG. 1.
Figure 10:
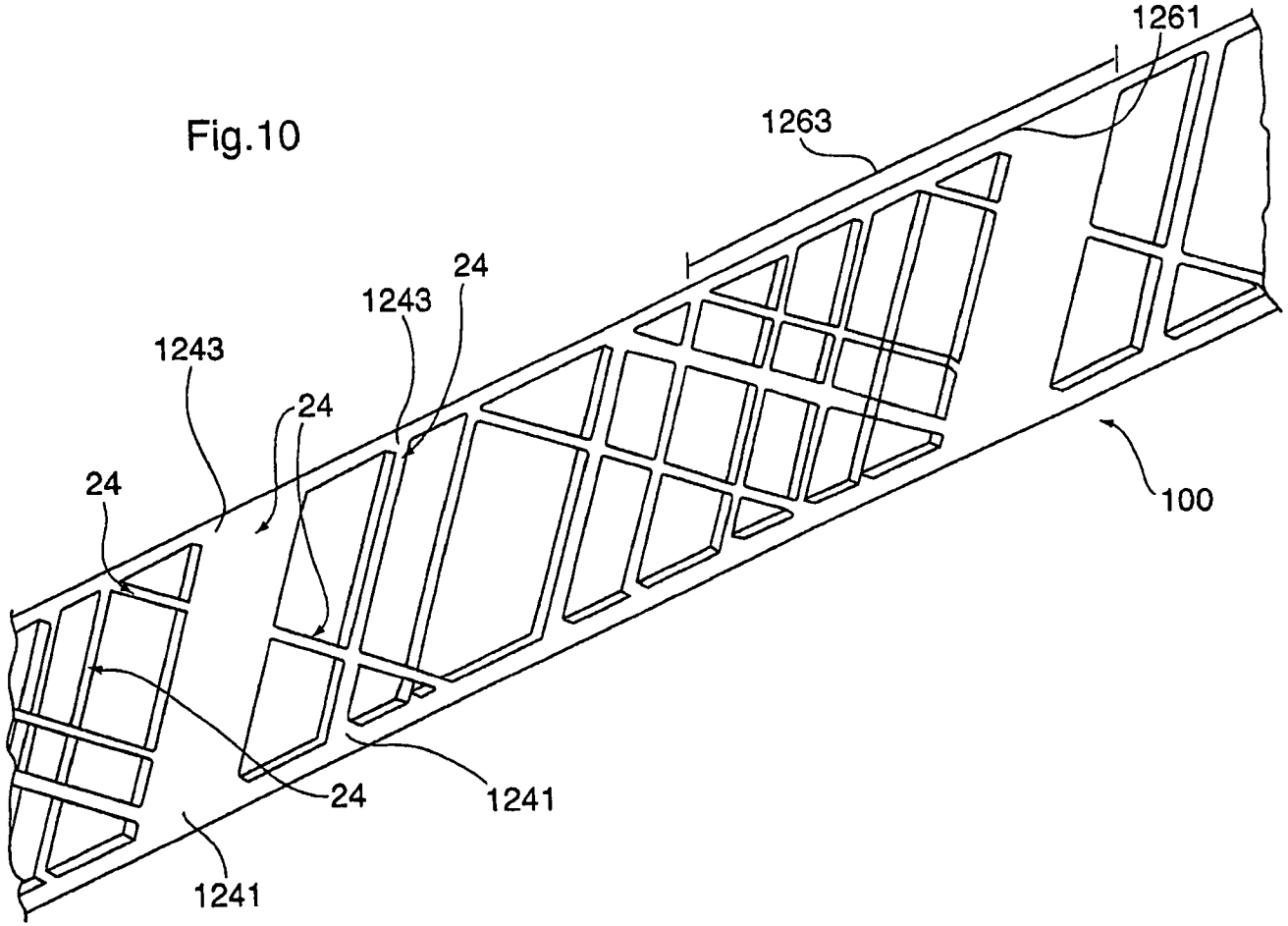
FIG. 10 is a fragmentary perspective view of a portion of the side of the sweatband illustrated in FIG. 2.
Figure 11:
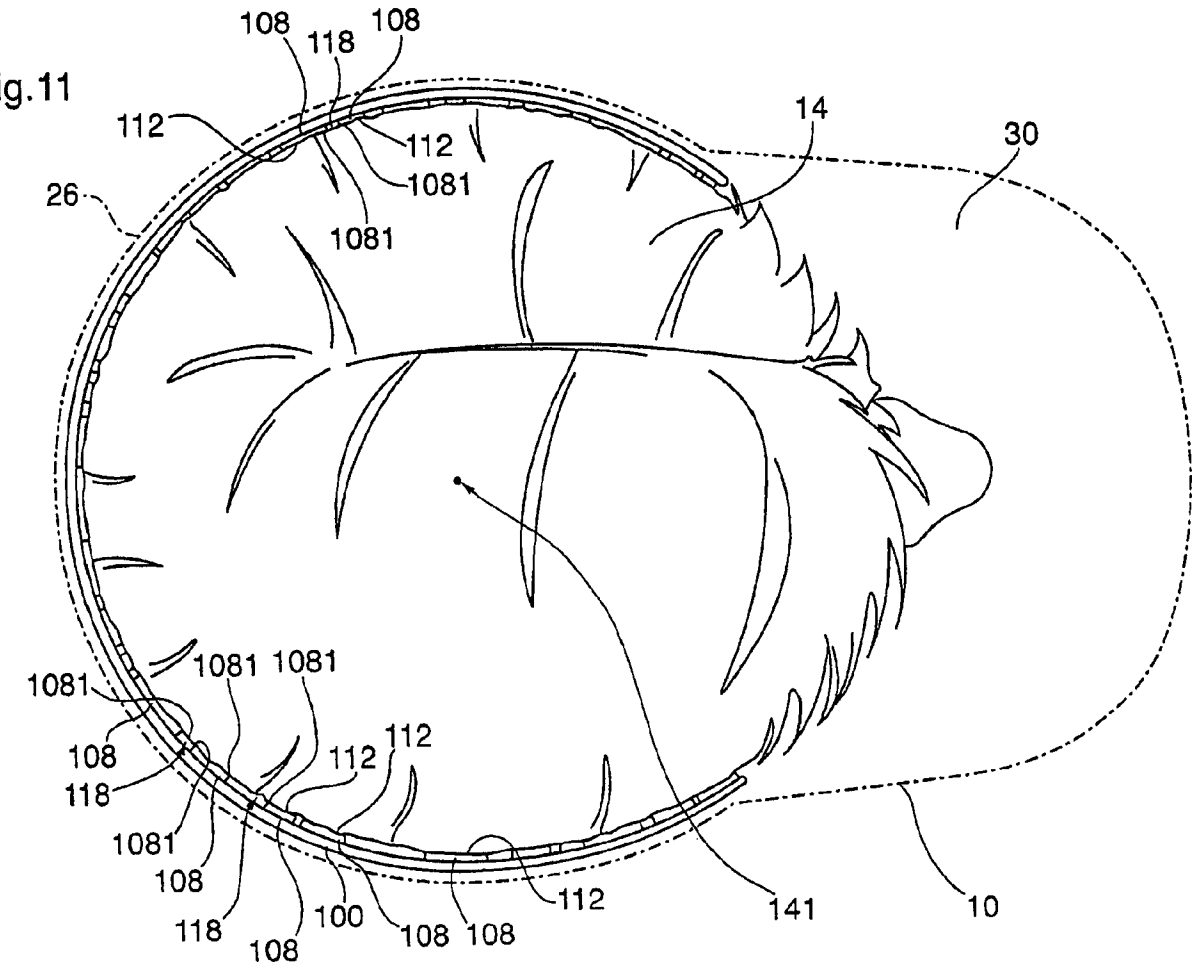
FIG. 11 is a cut-away top plan view of the headwear of FIG. 1, shown being worn on a human head, and, with the exception of the sweatband, the other elements of the headwear are shown in hidden lines for clarity.

Unless otherwise indicated, all numbers expressing quantities of ingredients, properties such as distance, operating conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain errors necessarily resulting from the standard deviation found in their respective testing measurements.

Referring to FIGS. 1 to 11, there is provided headwear 10 defining an opening 12 for receiving a human head 14.

The following discussion and associated figures describe the headwear 10 as having the form of a baseball cap. The concepts and features of the headwear 10 may be applied to a wide variety of headwear 10 types. Examples of such headwear 10 types include baseball caps (full-back and open-back), fedoras, "engineer"-type hats, "ivy"-type hats, "newsboy"-type hats, bucket hats, visors, and knitted hats.

The spatial disposition of certain elements of the headwear 10 are sometimes described relative to a head of a person received within a crown 26 of the headwear 10, or relative to other elements of the headwear 10, or relative to each other. It is intended to describe such spatial disposition when the headwear 10 is being worn in its intended position relative to the head 14 of a wearer. As well, terms such as "front", "rear", "side", "above", or "below" are also sometimes used to describe the disposition of elements of the headwear 10. Such terms are intended to refer to the disposition of the element relative to a head 14 of a person wearing the headwear 10, or relative to another element of the headwear 10, when the headwear 10 is being worn in its intended position relative to the head 14 of a wearer. For example, with respect to a baseball cap-type of headwear 10, the baseball cap is intended to be worn with its visor 30 extending forwardly relative to the forehead, even though the baseball cap may be worn with the visor 30 extending rearwardly or to one side.

For example, with respect to the headwear 10, the headwear 10 includes a crown 26, and the crown 26 is of a generally hemispherical form, including a lower edge 261, and is configured for the covering of a head 14 of a person.

For example, with further respect to the crown 26, the crown 26 includes a plurality of panels 28 (or gores) that are attached together along respective and abutting sides. For example, each of the panels 28 is made from flexible material. Also, for example, the panels 28 may be made from relatively inflexible material. With respect to the flexible material, for example, the flexible material is textile. For example, a suitable textile is fabric. For example, the flexible material can be made from a blend of weaveable fibers. For example, the flexible material is 100% wool. For example, the flexible material includes an elastic component, and the elastic component is characterized as being resilient. For example, the elastic component is spandex which is weaved into the flexible material. For example, the flexible material includes from 0 weight % to 5 weight % of elastic component based on the total weight of the flexible material. For example, the flexible material includes 3 weight % of the elastic component based on the total weight of the flexible material. For example, the elastic component is provided substantially uniformly throughout the flexible material.

For example, the attachment of the panel 28 is effected by the stitching together abutting sides of the panel 28 to define seams. For example, seam tape 70 may be applied to the interior surface across and joined to abutting panels 28 to reinforce the seams between panels 28. For example the seam tape 70 is stitched to each one of a respective one of each pair of abutting panels 28. For example the seam 70 includes the same material as that used for the panels 28. For example, with respect to each of the panels 28, the thickness of each of the panels is from one (1) millimeter to two (2) millimeters.

For example, with respect to the headwear 10, the headwear 10 further includes a peak 30. The peak 30 is attached to a front portion 32 of the crown 26 and extends forwardly of the crown 26. In this respect, the headwear 10 including a peak 30 is configured to be worn on the head 14 of a human such that the peak 30 extends forwardly relative to the face of the human. For example, with respect to the attachment of the peak 30 to the crown 26, the peak 30 is attached to the front facing portion of the crown 26 by sewing the peak to the front facing crown portion along and proximate to the bottom edge of the front facing crown portion. The lower edge of the front facing portion is folded inwardly along the length of the lower edge. A stiffening or reinforcing tape is then laid over the fold, and the peak 30 is then stitched along and proximate to the edge formed by the fold.

For example, with respect to the peak 30, the peak 30 includes material which is relatively more rigid than the crown portion to which the peak 30 is attached. For example, as is typical with peaks, the relatively more rigid material is a pre-molded and cut plastic form with a material sheath pulled over it.

For example, with respect to the crown portion attached along a rear edge 34 of the peak 30, from one side 31*a* of the peak 30 to the other side 31*b* of the peak 30, the crown portion includes a material band 36 disposed immediately above the peak 30. For example, the material band 26 is made from any one of: terry cloth, wicking fabric, cotton, wool, foam, and thick interface material. For example, the material band 36 is made from a water absorbent, wicking, fast-drying fabric. For example, an anti-microbial treatment is applied to the fabric. A suitable fabric material for this application is The New Generation Dry Best Ashanti™ material, supplied by Omnipel Technologies s.r.l. Via Monte Baldo, 117 I-25015 Desenzano of Italy.

A sweatband 100 is provided. The sweatband 100 is attached (such as by stitching) to the interior surface of the crown 26. For example, the sweatband is attached proximate to the lower edge 261 of the crown 26. For example, the sweatband includes a minimum width 1001 of at least 0.75 inches. For example, the minimum width 1001 is less than 1.5 inches. For example, the width of the sweatband is substantially the same across substantially the entire length of the sweatband, and, for example, the width in such an exemplary embodiment is 1.25 inches.

The sweatband 100 includes a first side surface 102 configured for opposing the head 14 of a wearer when the headwear 10 is worn on a human head. The sweatband 100 also includes a second side surface 104 disposed on a side opposite to the first side surface 102 and opposing the interior surface of the crown 26. For example, the sweatband has elastic properties. The first side surface 102 of the sweatband 100 includes an outermost surface 106. For example, the first side surface 102 is subjected to an antimicrobial treatment. For example, a suitable antimicrobial treatment is that provided by applying ACT Advanced Composite Technology™, supplied by Next Technology LLC of 2220 Bethany Road, Madison, N.C., U.S.A., 27025.

First Aspect of the Sweatband of the Headwear

In one aspect, the sweatband 100 includes at least one pair of spaced-apart successive head contacting domains 108. At least a respective portion 112 of each one of the spaced-apart successive head contacting domains 108, of each one of the at least one pair of spaced-apart successive head contacting domains 108, is configured to contact the head 14 of the wearer when the headwear 10 is worn on a human head 14.

With respect to each one of the at least one pair of spaced apart successive head contacting domains 108, it is understood that each one of the head contacting domains 108 is not necessarily defined by a continuous and uninterrupted surface. It is also understood that the head contacting domain 108 may include a recessed portion such that a space is provided between the recessed portion and a human head 10 when the headwear 10 is worn by a human, but not where the space corresponds to the recessed domain 116 (see below).

The sweatband also includes at least one channel 24. Each one of the at least one channel 24 is configured to facilitate air flow between a space 120 above the sweatband 100 and a space 122 below the sweatband 100, when the headwear 10 is worn on a human head 14. Each one of the at least one channel includes at least one recessed domain 116. Each one of the at least one recessed domain 116 is defined between a respective edge portion 1081 of each one of the spaced-apart successive head contacting domains 108 of at least one of the at least one pair of spaced-apart successive head contacting domains 108 (because two or more channels may intersect to define a single space in some embodiments). For example, each one of the at least one channel extends from substantially at an upper edge 126 of the sweatband 100 to substantially a lower edge 128 of the sweatband 100. For example, there is provided a plurality channels 24. For example, where there is provided a plurality of channels 24, at least one of the plurality of channels 24 is interconnected with another one or with other ones of the plurality of channels 24.

In some embodiments, when the headwear 10 is free-standing and is supported on a horizontally planar surface such that at least a rear portion of the lower edge 261 of the crown 26 is contacting the horizontally planar support surface such that at least a rear portion of the lower edge of the crown is contacting the horizontally planar support surface, and for at least one operative channel 24, wherein each one of the at least one operative channel 24 is at least a portion of one of the at least one channel 24 and is defined by at least one recessed domain 116 and each one of the at least one recessed domain 116 is defined between a respective edge portion 1081 of each one of the spaced-apart successive head contacting domains 108 of a one of the at least one pair of spaced-apart successive head contacting domains 108, and for each one of the at least one recessed domain 108 of each one of the at least one operative channel 24, within each horizontal plane which traverses each one of the spaced-apart head contacting domains 108 of the pair of spaced-apart successive head contacting domains 108 between which the recessed domain 116 is disposed, each one of the spaced-apart head contacting domains 108 of the pair of spaced-apart successive head contacting domains 108 between which the recessed domain is disposed includes a most internally extending outermost surface portion. The recessed domain 116 includes a most internally extending outermost surface portion and is characterized by a first recess depth 136 relative to a one of the spaced-apart successive head contacting domains 108 of the pair of spaced-apart successive head contacting domains 108 between which the recessed domain 116 is disposed. The first recess depth 136 is a linear distance between a plane tangent to the most internally extending outermost surface portion 130 of the one of the spaced-apart successive head contacting domains 108 of the pair of spaced-apart successive head contacting domains 108 between which the recessed domain 116 is disposed and a plane tangent to the most internally extending outermost surface portion 134 of the recessed domain 116. The recessed domain 116 is also characterized by a second recess depth 138 relative to the other one of the spaced-apart successive head contacting domains 108 of the pair of spaced-apart successive head contacting domains 108 between which the recessed domain 116 is disposed. The second recess depth 138 is a linear distance between a plane tangent to the most internally extending outermost surface portion 130 of the other one of the spaced-apart successive head contacting domains 108 of the pair of spaced-apart successive head contacting domains 108 and a plane tangent to the most internally extending outermost surface portion 134 of the recessed domain 116. The first recess depth 136 is at least 0.5 millimeters and the second recess depth 138 is at least 0.5 millimeters. For example, the recess depth 136 of each one of the at least one operative recessed domain is between 0.5 millimeters and 1.5 millimeters, and the recess depth 138 of each one of the at least one operative recessed domain is between 0.5 millimeters and 1.5 millimeters. For example, the recess depth 136 of each one of the at least one operative recessed domain is 1.0 millimeters, and the recess depth 138 of each one of the at least one operative recessed domain is 1.0 millimeters.

In some embodiments, at least one of the at least one channel 24 is an operative channel 24, and the minimum width 241 of each one of the at least one operative channel 24 is at least 1.0 millimeters. For example, the minimum width 241 of each one of the at least one operative channel 24 is at least 2.0 millimeters. For example, the minimum width 241 of each one of the at least one operative channel 24 is between 1.0 millimeters and 14 millimeters. For example, for each one of the at least one operative channel 24, the width is substantially the same across the depth of each one of the respective at least one recessed domain 116, and is between 2.0 and 2.5 millimeters. As a further example, for each one of the at least one operative channel 24, the width is substantially the same across the depth of each one of the respective at least one recessed domain 116, and is 14 millimeters.

In some embodiments, when the headwear 10 is being worn on a human head 14, and the human head 14 is positioned such that a plane tangent to the highest portion 141 of the human head 14 is substantially horizontal (in this position, the human head is also described as being positioned in a forward-looking an untilted position), and for at least one operative channel 24, wherein each one of the at least one operative channel 24 is a one of the at least one channel 24 and is defined by at least one recessed domain 116 and each one of the at least one recessed domain 116 is defined between a respective edge portion 1081 of each one of the spaced-apart successive head contacting domains 108 of a one of the at least one pair of spaced-apart successive head contacting domains 108, and for each one of the at least one recessed domain 116 of each one of the at least one operative channel 24, at least the respective edge portions 130 of each one of the spaced-apart successive head contacting domains 108, between which the recessed domain 116 is disposed, are disposed in contact with the human head 14 such that there is provided a passage 118 configured to flow air between a space 120 above the sweatband 100 and a space 122 below the sweatband 100 and the passage 118 includes a minimum cross-sectional area of at least 0.5 square millimeters (0.5 $mm^2$). For example, the minimum cross-sectional area of each one of the at least one passage 118 is least 2.0 square millimeters (2.0 $mm^2$). For example, the minimum cross-sectional area of each one of the at least one passage 118 is between 0.5 square millimeters (0.5 $mm^2$) and 21 square millimeters (21 $mm^2$). For example, the minimum cross-sectional area of each one of the at least one passage 118 is between 2.0 square millimeters (2.0 $mm^2$) and 2.5 square millimeter (2.5 $mm^2$).

Second Aspect of the Sweatband of the Headwear

In another aspect, the at least one pair of spaced-apart successive head contacting domains 108 is a plurality of pairs of spaced-apart successive head contacting domains 108, and the at least one channel 24 is a plurality of channels 24. Each one of the plurality of channels 24 is configured to facilitate air flow between a space 120 above the sweatband 100 and a space 122 below the sweatband 100, when the headwear 10 is worn on a human head 14. Each one of the plurality of channels 24 includes at least one recessed domain 116, such that a plurality of recessed domains 116 is provided. Each one of the plurality of recessed domains 116 is defined between a respective edge portion 1081 of each one of the spaced-apart successive head contacting domains 108 of at least one of the plurality of pairs of spaced-apart successive head contacting domains 108. For example, each one of the plurality of channels 24 extends from substantially at an upper edge 126 of the sweatband 100 to substantially a lower edge 128 of the sweatband 100. For example, at least one of the plurality of channels 24 is interconnected with another one or with other ones of the plurality of channels 24.

In some embodiments, when the headwear 10 is being worn on a human head 14, and the human head 14 is positioned such that a plane tangent to the highest portion 141 of the human head 14 is substantially horizontal (in this position, the human head 14 is also described as being positioned in a forward-looking an untilted position), and for at least two operative channels 24, wherein each one of the at least two operative channels 24 is a one of the plurality of channels 24 and is defined by at least one recessed domain 116 and each one of the at least one recessed domain 116 is defined between a respective edge portion 1081 of each one of the spaced-apart successive head contacting domains 108 of a one of the plurality of pairs of spaced-apart successive head contacting domains 108, and for each one of the at least one recessed domain 116 of each one of the at least two operative channels 24, at least the respective edge portions 1081 of each one of the spaced-apart successive head contacting domains 108, between which the recessed domain 116 is disposed, are disposed in contact with the human head 14 such that there is provided a passage 118 configured to flow air between a space 120 above the sweatband 100 and a space 122 below the sweatband 100 and the passage 118 includes a minimum cross-sectional area of at least 0.5 square millimeters (0.5 $mm^2$). For example, the minimum cross-sectional area of each one of the at least one passage 118 is least 2.0 square millimeters (2.0 $mm^2$). For example, the minimum cross-sectional area of each one of the at least one passage 118 is between 0.5 square millimeters (0.5 $mm^2$) and 21 square millimeters (21 $mm^2$). For example, the minimum cross-sectional area of each one of the at least one passage 118 is between 2.0 square millimeters (2.0 $mm^2$) and 2.5 square millimeter (2.5 $mm^2$).

In some embodiments, at least two of the plurality of channels 24 are operative channels 24 such that at least two operative channels 24 are provided. Each one of the at least two operative channels 24 includes a minimum width 241 of at least 1.0 millimeters. For example, the minimum width 241 of each one of the at least two operative channels 24 is at least 2.0 millimeters. For example, the minimum width 241 of each one of the at least two operative channels 24 is between 1.0 millimeters and 14 millimeters. For example, for each one of the at least two operative channels 24, the width is substantially the same across the depth of the recessed domain, and is between 2.0 and 2.5 millimeters. As a further example, for each one of the at least two operative channels 24, the width is substantially the same across the depth of the recessed domain, and is 14 millimeters.

Each one of the plurality of channels 24 includes opposite ends, and each one of the opposite ends includes a respective one of the channel ports 1241, 1243. The channel port 1241 opens into the space 120 disposed above the sweatband 100. For example, the channel port 1241 is disposed substantially at an upper edge 126 of the sweatband 100. The channel port 1243 opens into the space 122 disposed below the sweatband 100. For example, the channel port 1243 is disposed substantially at a lower edge 128 of the sweatband 100. In this respect, there is provided an upper edge portion 1261 including an upper edge portion length 1263 measured along the upper edge portion 1261, and a plurality of channel ports 1241, and each one of the plurality of channel ports 1241 opens into the space 120 disposed above the upper edge portion 1261 of the sweatband 100 and effects fluid communication between the space 120 disposed above the sweatband 120 and a respective one of the plurality of channels 24.

In some embodiment, at least two of the plurality of channel ports 1241 are operative channel ports 1241 such that at least two operative channel ports 1241 are provided. Each one of the at least two operative channel ports 1241 opens into the space 120 disposed above the upper edge portion 1261 of the sweatband 100 and effects fluid communication between the space 120 disposed above the sweatband 100 and a respective one of the at least two operative channels 24. The ratio of the number of operative channel ports 1241 to upper edge portion length 1263 is at least 0.8 operative channel ports per inch of upper edge portion length. For example, this ratio is at least 1.6 operative channel ports per inch of upper edge portion length. As a further example, this ratio is at least 3.2 operative channel ports per inch of upper edge portion length.

In some embodiments, the at least two operative channel ports 24 includes at least one pair of successive operative channel ports 1241. The successive operative channel ports 1241 of at least one of the at least one pair of successive operative channel ports 1241 are spaced apart from one another by a linear distance of at least 0.2 centimeters. The linear distance is measured in a horizontal plane between respective longitudinal axes of each one of the successive operative channel ports 1241 of each one of the at least one of the at least one pair of successive operative channel ports 1241 when the headwear 10 is free-standing and supported on a horizontal planar surface such that at least a rear portion of the lower edge 1261 of the crown 26 is contacting the horizontally planar support surface. For example, this linear distance is at least 0.2 centimeters. For example, this linear distance is at least 0.3 centimeters. For example, this linear distance is less than 2.0 centimeters. For example, this linear distance is between 0.2 centimeters and 2.0 centimeters. For example, this linear distance is 1.2 centimeters.

Example of Manufacturing an Embodiment of a Sweatband for Headwear

A suitable sweatband 100 is manufactured using a computer-controlled Jacquard-type knitting machine. An exemplary Jacquard-type knitting machine is Model No. NF642 manufactured by Jakob Muller AG, Frick of Frick, Switzerland. For example, the Jacquard-type knitting machine is controlled using MUCAD Micro™ computer software available from Jakob Muller AG, Frick of Frick, Switzerland, which has been user-formatted according to design specifications.

Figure 12:
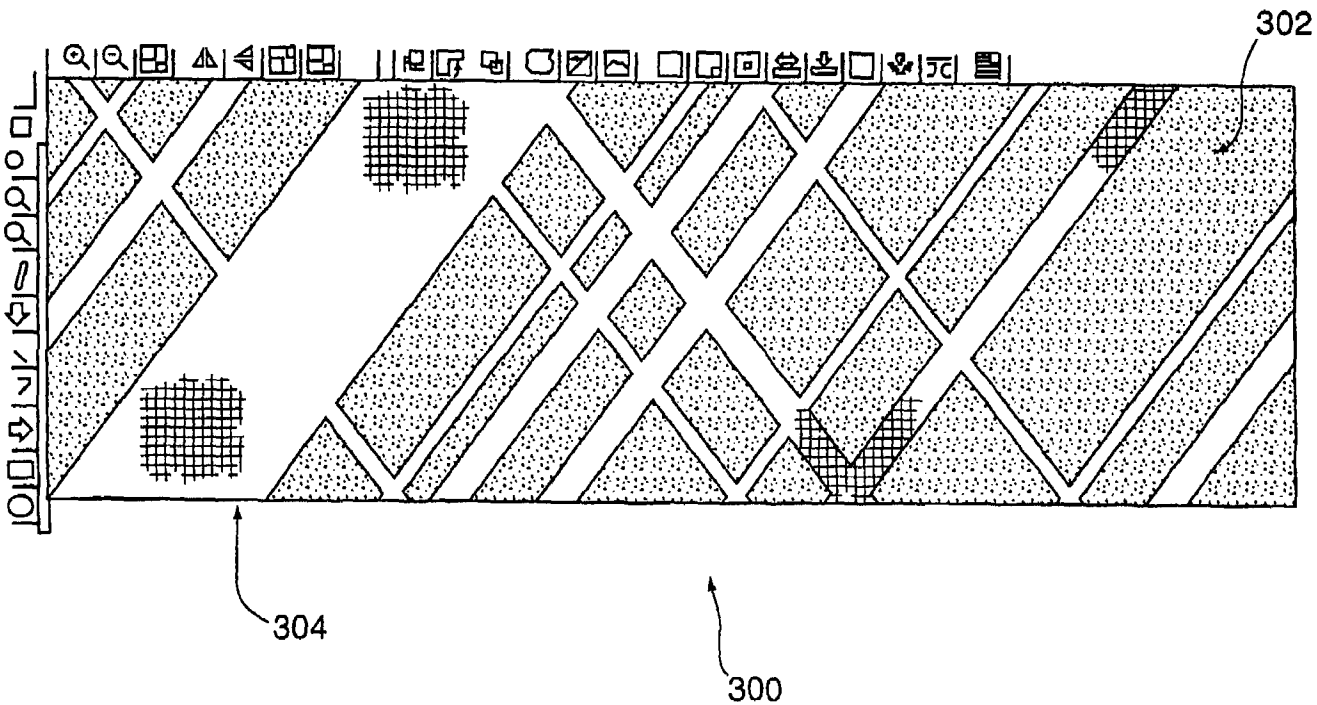
FIG. 12 is a schematic of a desired pattern for an embodiment of a side of the sweatband configured to oppose a head when the sweatband is incorporated in headwear, where the desired pattern has been user-inputted into computer software to effect programming of a knitting machine for manufacturing the sweatband.

The design specifications include a desired pattern 300. An exemplary pattern of the sweatband 100 is illustrated in FIG. 12. The lighter coloured regions 302 represent raised areas of head contacting domains 108. The lighter coloured regions 302 consist of two different kinds of wicking polyester which are wound together. For example, the two different kinds of wicking polyester are as follows: (i) 300 Denier thread of wicking polyester, and (ii) 150 Denier thread of wicking polyester, and (i) and (ii) are combined in a volumetric ratio of 1:2. The darker coloured regions 304 represent recessed areas of recessed domains 116. The darker coloured regions 304 consist of two different kinds of Nylon™ which are wrapped or wound together. For example, the two different kinds of Nylon™ are as follows: (i) 2×70 Denier threads of grey coloured Nylon™, and (ii) 2×70 Denier threads of white coloured Nylon™, and (i) and (ii) are combined in a volumetric ratio of 1:1. In making the sweatband 100 having the pattern illustrated in FIG. 12, the two different kinds of Nylon™ are woven with and onto spandex material to form a dark layer comprising substantially the two different kinds (above-described) Nylon™. The raised, lighter coloured regions of the two kinds of wicking polyester are then formed by weaving the two kinds of wicking polyester with and onto predetermined regions of the dark layer. The material composition of the sweatband is as follows: (i) 18 weight % of 300 Denier thread of wicking polyester, based on the total weight of the sweatband, (ii) 18 weight % of 150 Denier thread of wicking polyester, based on the total weight of the headband, (iii) 14 weight % of 2×70 Denier threads of grey coloured Nylon™, based on the total weight of the headband, (iv) 36 weight % of 2×70 Denier threads of white coloured Nylon™, based on the total weight of the headband, and (v) 13 weight % spandex, based on the total weight of the headband. The formed sweatband 100 is characterized as being of a substantially two-way stretch (ie. substantially stretchable only along its axis). The fabric count of the sweatband material, determined in accordance with ASTM D3775-2003A, is 241 ends per inch and 78 picks per inch.

Although the disclosure describes and illustrates various embodiments of the invention, it is to be understood that the invention is not limited to these particular embodiments. Many variations and modifications will now occur to those skilled in the art of headwear. For full definition of the scope of the invention, reference is to be made to the appended claims.

The invention claimed is:

1. A sweatband configured for attachment to an interior surface of a headwear for absorbing liquid from a head of a wearer of the headwear and including a side surface configured for disposition opposite to the head of the wearer when the sweatband is attached to the interior surface of the headwear and the headwear is being worn by the wearer, the side surface comprising:

a plurality of pairs of spaced-apart successive head contacting domains, wherein at least a respective portion of each one of the spaced-apart successive head contacting domains of each one of the plurality of pairs of spaced-apart successive head contacting domains is configured to contact the head of the wearer when the headwear is worn on a human head;

a plurality of channels, wherein each one of the plurality of channels is configured to facilitate air flow between a space above the sweatband and a space below the sweatband when the headwear is worn on a human head, wherein at least one of the plurality of channels extends to and through a lower side edge of the sweatband to and through an upper side edge of the sweatband, wherein there is provided an upper edge portion of the upper side edge of the sweatband including an upper edge portion length measured along the upper edge portion, and a plurality of successive channel ports, each one of the plurality of channel ports is spaced apart from one another, and each one of the plurality of channel ports opens into the space disposed above the upper edge portion of the sweatband and effects fluid communication between the space disposed above the sweatband and a respective one of the plurality of channels, and wherein each one of at least two of the plurality of channel ports opens into the space disposed above the upper edge portion of the sweatband and effects fluid communication between the space disposed above the sweatband and a respective one of at least two of the plurality of channels, each of the at least two of the plurality of channels being interconnected with at least an other one of the plurality of channels by intersecting at a location between the upper side edge of the sweatband and the lower side edge of the sweatband.

2. The sweatband as claimed in claim 1, wherein the at least two of the plurality of channel ports includes at least one pair of successive channel ports, and wherein the successive operative channel ports of at least one of the at least one pair of successive operative channel ports are spaced apart from one another by a linear distance measured in a horizontal plane between respective longitudinal axes of each one of the successive channel ports of each one of the at least one of the at least one pair of successive channel ports.

3. The sweatband as claimed in claim 1, wherein the linear distance is at least 0.02 centimeters.

4. Headwear including the sweatband as claimed in claim 1.

5. The sweatband as claimed in claim 1, wherein at least a portion of at least one of the plurality of channels includes a minimum width of at least 1.0 millimeter.

6. The sweatband as claimed in claim 1, wherein the ratio of the number of channel ports to upper edge portion length is at least 0.8 channel ports per inch of upper edge portion length.

7. The sweatband as claimed in claim 1, wherein the at least one of the plurality of channels includes a minimum cross-sectional area of at least 0.5 square millimeters (0.5 $mm^2$).

8. The sweatband as claimed in claim 1, wherein at least two of the plurality of pairs of spaced apart successive head contacting domains are space-apart by at least one of the plurality of channels, each of the at least two of the plurality of pairs of spaced-apart successive head contacting domains including a most internally extending outermost surface portion, and the respective at least one of the plurality of channels including a most internally extending outermost surface portion and is characterized by a first recess depth relative to a one of the at least two of the plurality of pairs of spaced-apart successive head contacting domains, wherein the first recess depth is a linear distance between a plane tangent to the most internally extending outermost surface portion of the one of the at least two of the plurality of pairs of spaced-apart successive head contacting domains between which the at least one of the plurality of channels is disposed and a plane tangent to the most internally extending outermost surface portion of the at least one of the plurality of channels, wherein the first recess depth is at least 0.5 millimeters.

9. The sweatband as claims in claim 8, wherein the at least one of the plurality of channels is also characterized by a second recess depth relative to the other one of the at least two of the plurality of pairs of spaced-apart successive head contacting domains between which the at least one of the plurality of channels is disposed, wherein the second recess depth is a linear distance between a plane tangent to the most internally extending outermost surface portion of the other one of the at least two of the plurality of pairs of spaced-apart successive head contacting domains and a plane tangent to the most internally extending outermost surface portion of the at least one of the plurality of channels, wherein the second recess depth is at least 0.5 millimeters.

10. The sweatband as claimed in claim 8, wherein at least a portion of the at least one of the plurality of channels includes a minimum width of at least 0.5 millimeters.

* * * * *